US012553437B2

(12) United States Patent
Bonnefoi et al.

(10) Patent No.: US 12,553,437 B2
(45) Date of Patent: Feb. 17, 2026

(54) COMPRESSOR SCROLL PROVIDED WITH AN OIL SUMP FAIRING

(71) Applicant: DANFOSS COMMERCIAL COMPRESSORS, Trevoux (FR)

(72) Inventors: Patrice Bonnefoi, Nordborg (DK); Florent Bergeon, Nordborg (DK); Gabriel Streda, Nordborg (DK); Brian Angel, Nordborg (DK); Gang Yao, Nordborg (DK); Qian Hu, Nordborg (DK)

(73) Assignee: Danfoss Commercial Compressors, Reyrieux (FR)

( * ) Notice: Subject to any disclaimer, the term of this patent is extended or adjusted under 35 U.S.C. 154(b) by 0 days.

(21) Appl. No.: 18/720,744

(22) PCT Filed: Dec. 8, 2022

(86) PCT No.: PCT/EP2022/084998
§ 371 (c)(1),
(2) Date: Jun. 17, 2024

(87) PCT Pub. No.: WO2023/110623
PCT Pub. Date: Jun. 22, 2023

(65) Prior Publication Data

US 2025/0052242 A1 Feb. 13, 2025

(30) Foreign Application Priority Data

Dec. 17, 2021 (CN) ..... 202111557974.6

(51) Int. Cl.
*F04C 29/02* (2006.01)
*F04C 18/02* (2006.01)
*F04C 29/04* (2006.01)

(52) U.S. Cl.
CPC ..... *F04C 29/026* (2013.01); *F04C 18/0207* (2013.01); *F04C 29/023* (2013.01);
(Continued)

(58) Field of Classification Search
CPC ..... F04C 29/02; F04C 29/021; F04C 29/026; F04C 29/028; F04C 29/04; F04C 29/045;
(Continued)

(56) References Cited

U.S. PATENT DOCUMENTS 4,621,993 A 11/1986 Nakamura et al.
2003/0228233 A1 12/2003 Dreiman et al.
(Continued)

FOREIGN PATENT DOCUMENTS

CN 1344864 A 4/2002
CN 1482365 A 3/2004
(Continued)

OTHER PUBLICATIONS

French Search Report for FR Application No. 2200020 dated Oct. 13, 2023.
(Continued)

*Primary Examiner* — Mark A Laurenzi
*Assistant Examiner* — Xiaoting Hu
(74) *Attorney, Agent, or Firm* — Carlson, Gaskey & Olds, P.C.

(57) ABSTRACT

A scroll compressor including a hermetic casing provided with a suction inlet; a compression unit; a drive shaft configured to drive an orbiting scroll of the compression unit in an orbital movement; an electric motor coupled to the drive shaft; an oil sump; a refrigerant guiding device configured to force a main part of a refrigerant, entering the scroll compressor through the suction inlet, to flow downwardly through the electric motor, before reaching the compression unit; and an oil sump fairing arranged between
(Continued)

a lower end of the electric motor and a free surface of oil stored in the oil sump, the oil sump fairing being configured to prevent a refrigerant flow, emerging from the lower end of the electric motor, to directly impact the free surface of the oil stored in the oil sump.

20 Claims, 2 Drawing Sheets

(52) U.S. Cl.
CPC ..... *F04C 29/045* (2013.01); *F04C 29/028* (2013.01); *F04C 2240/30* (2013.01); *F04C 2240/809* (2013.01)

(58) Field of Classification Search
CPC ..... F04C 2240/809; F04C 2240/40; F04C 2240/30; F04C 18/0207–0292; F04C 23/008
See application file for complete search history.

(56) References Cited

U.S. PATENT DOCUMENTS

| | | | | |
|---|---|---|---|---|
| 2004/0126261 | A1 | 7/2004 | Kammhoff et al. | |
| 2007/0183917 | A1* | 8/2007 | Um | F04C 18/0215 418/55.6 |
| 2014/0140867 | A1 | 5/2014 | Bonnefoi et al. | |

FOREIGN PATENT DOCUMENTS

| | | | | |
|---|---|---|---|---|
| CN | 101539145 | A | 9/2009 | |
| CN | 113279963 | A | 8/2021 | |
| EP | 3258106 | A1 * | 12/2017 | F04B 39/02 |
| JP | H0211889 | A * | 1/1990 | |
| JP | H0347496 | A * | 2/1991 | |
| JP | H1047283 | A * | 2/1998 | |
| JP | 4979473 | B2 | 7/2012 | |

OTHER PUBLICATIONS

International Search Report and Written Opinion for International application No. PCT/EP2022/084998 dated Mar. 14, 2023.

* cited by examiner

COMPRESSOR SCROLL PROVIDED WITH AN OIL SUMP FAIRING

CROSS REFERENCE TO RELATED APPLICATIONS

This application is the national stage application of PCT/EP2022/084998, filed Dec. 8, 2022, which claims priority to CN Application No. 202111557974.6, filed Dec. 17, 2021.

TECHNICAL FELD

The present disclosure relates to a scroll compressor, and in particular to a scroll refrigeration compressor.

BACKGROUND

As known, a scroll compressor includes: a hermetic casing provided with a suction inlet configured to supply the scroll compressor with refrigerant to be compressed, a compression unit arranged within the hermetic casing and configured to compress the refrigerant supplied by the suction inlet, a drive shaft configured to drive an orbiting scroll of the compression unit in an orbital movement, the drive shaft being rotatable around a rotation axis, an electric motor coupled to the drive shaft and configured to drive in rotation the drive shaft about the rotational axis, the electric motor including a rotor which is secured to the drive shaft and a stator which is disposed around the rotor, the stator including a stator core, also named stator stack, and a stator windings wound on the stator core, the stator windings defining an upper stator end winding, also named upper stator winding head, and a lower stator end winding, also named lower stator winding head, and an oil sump located at a lower part of the hermetic casing, and for example defined by the hermetic casing.

In order to ensure an optimal cooling of the electric motor, and particularly of the lower stator end winding, it is known to provide such a scroll compressor with a refrigerant guiding device configured to force a main part of the refrigerant, entering the scroll compressor through the suction inlet, to flow through the electric motor from the upper stator end winding to the lower stator end winding, before said refrigerant reaches the compression unit.

However, in such a case, the refrigerant flow emerging from a lower end of the electric motor directly impacts the free surface of oil stored in the oil sump arranged at the bottom of the hermetic casing, which causes the creation of oil droplets at the free surface of the oil stored in the sump and which thus increases the quantity of oil carried by the refrigerant.

Consequently, although such a configuration of the scroll compressor improves the motor cooling, it induces an increased oil circulation rate (OCR) within the refrigeration system, which could be harmful for a variable speed compressor when operating at high speed.

SUMMARY

It is an object of the present disclosure to provide an improved scroll compressor which can overcome the drawbacks encountered in conventional scroll compressors.

Particularly, an object of the present disclosure is to provide a scroll compressor, especially a variable speed scroll compressor, with an improved motor cooling and reduced OCR at high speed.

According to the disclosure, such a scroll compressor includes: a hermetic casing provided with a suction inlet configured to supply the scroll compressor with refrigerant to be compressed, a compression unit arranged within the hermetic casing and configured to compress the refrigerant supplied by the suction inlet, a drive shaft configured to drive an orbiting scroll of the compression unit in an orbital movement, the drive shaft being rotatable around a rotation axis, an electric motor coupled to the drive shaft and configured to drive in rotation the drive shaft about the rotational axis, the electric motor including a rotor which is secured to the drive shaft and a stator which is disposed around the rotor, the stator including a stator core, and a stator windings wound on the stator core, the stator windings defining an upper stator end winding and a lower stator end winding, an oil sump located at a lower part of the hermetic casing, and for example defined by the hermetic casing, a refrigerant guiding device configured to force a main part, for example at least 80% and advantageously substantially the entire, of the refrigerant, entering the scroll compressor through the suction inlet, to flow through the electric motor, and for example at least partially through a circular gap defined between the rotor and the stator, from the upper stator end winding to the lower stator end winding, before reaching the compression unit, and an oil sump fairing arranged between a lower end of the electric motor and a free surface of oil stored in the oil sump, the oil sump fairing being configured to prevent a refrigerant flow, flowing downwardly through the electric motor and coming out of, i.e. emerging from, the electric motor, to directly impact the free surface of the oil stored in the oil sump.

The oil sump fairing device avoids direct impact or disturbance of the oil surface of an oil sump arranged at the bottom of the hermetic casing by the refrigerant flow or by a rotating lower counterweight connected to the drive shaft. Hereby, entrainment of oil in the refrigerant flow and increased oil circulation rate (OCR) within the refrigeration system are prevented.

In addition, the oil sump fairing redirects the refrigerant flow, coming out of the electric motor, towards the compression unit of the scroll compressor, which contributes to a separation of oil entrained in the refrigerant passing the electric motor, leading to a further reduction of the OCR.

Further, as this redirection occurs in close vicinity of the lower stator end winding, an improved cooling also of the lower stator end winding is achieved.

The scroll compressor may also include one or more of the following features, taken alone or in combination.

According to an embodiment of the disclosure, the upper stator end winding is formed by the portions of stator windings extending upwardly from an upper end face of a stator core, and the lower stator end winding is formed by the portions of the stator windings extending downwardly from a lower end face of the stator core.

According to an embodiment of the disclosure, the oil sump fairing is configured to deflect, and particularly to orient, the refrigerant flow, flowing downwardly through the electric motor and coming out of the electric motor, away from the oil sump.

According to an embodiment of the disclosure, the oil sump fairing is configured to deflect the refrigerant flow, flowing downwardly through the electric motor and coming out of the electric motor, towards the compression unit.

According to an embodiment of the disclosure, the oil sump fairing forms an oil sump protective shield.

According to an embodiment of the disclosure, the oil sump fairing is cup-shaped. Such a configuration of the oil sump fairing forces the refrigerant emerging from the lower end of the electric motor to make a U-turn.

According to an embodiment of the disclosure, the oil sump fairing surrounds the drive shaft, and advantageously a lower end part of the drive shaft.

According to an embodiment of the disclosure, the oil sump fairing is arranged substantially coaxially with the electric motor.

According to an embodiment of the disclosure, the oil sump fairing includes: a bottom portion which is facing a lower axial end of the electric motor, and particularly of the stator core, the bottom portion having an inner circumferential edge and an outer circumferential edge, and a circumferential wall portion extending along the outer circumferential edge of the bottom portion and upwardly from said outer circumferential edge.

According to an embodiment of the disclosure, the bottom portion has a globally plate shape.

According to an embodiment of the disclosure, the circumferential wall portion has a cylindrical shape.

According to an embodiment of the disclosure, the bottom portion at least partially covers the oil sump.

According to an embodiment of the disclosure, the bottom portion has substantially a disc-shape.

According to an embodiment of the disclosure, the circumferential wall portion and the electric motor extend coaxially.

According to an embodiment of the disclosure, the circumferential wall portion has an inner diameter which is higher than an outer diameter of the stator core.

According to an embodiment of the disclosure, the circumferential wall portion surrounds a lower end portion of the lower stator end winding with a predetermined distance, such that a refrigerant flow path is formed between an inner surface of the circumferential wall portion and the lower end portion of the lower stator end winding.

According to an embodiment of the disclosure, the refrigerant flow path has a ring-shaped cross section.

According to an embodiment of the disclosure, the bottom portion comprises at least one oil drain opening configured to drain oil collected by the oil sump fairing towards the oil sump.

According to an embodiment of the disclosure, the at least one oil drain opening is formed at or close to the outer circumferential edge of the bottom portion.

According to an embodiment of the disclosure, the at least one oil drain opening is elongated and extends along a part of the outer circumferential edge of the bottom portion.

According to an embodiment of the disclosure, the bottom portion comprises several oil drain openings distributed, and for example evenly distributed, around the drive shaft.

According to an embodiment of the disclosure, the bottom portion is conically shaped, the outer circumferential edge of the bottom portion being closer to the oil sump than the inner circumferential edge of the bottom portion. Due to such a configuration, the bottom portion is configured to orient oil collected by the oil sump fairing towards the outer circumferential edge of the bottom portion, and particularly towards the at least one oil drain opening.

According to an embodiment of the disclosure, the oil sump fairing has a central opening for accommodating the drive shaft.

According to an embodiment of the disclosure, the central opening is provided on the bottom portion.

According to an embodiment of the disclosure, the bottom portion includes a first annular part facing a lower axial end of the rotor and delimiting the central opening, and a second annular part being formed radially outward of the first annular part and facing a lower axial end of the stator.

According to an embodiment of the disclosure, the refrigerant guiding device includes a motor cover arranged at and covering the upper stator end winding of the electric motor, the motor cover and the electric motor at least partially defining an inner chamber, which may be annular, containing the upper stator end winding, the motor cover including a refrigerant inlet opening emerging in the inner chamber and at least partially facing the suction inlet.

According to an embodiment of the disclosure, the refrigerant guiding device is configured to force a main part, for example at least 80% and advantageously substantially the entire, of the refrigerant, entering the scroll compressor through the suction inlet, to flow through the refrigerant inlet opening before flowing through the electric motor from the upper stator end winding to the lower stator end winding.

According to an embodiment of the disclosure, the refrigerant inlet opening has a cross-section which is higher than a cross-section of the suction inlet.

According to an embodiment of the disclosure, the motor cover is attached to the stator core.

According to an embodiment of the disclosure, the motor cover surrounds the drive shaft.

According to an embodiment of the disclosure, the refrigerant guiding device is configured to force the refrigerant entering the inner chamber to flow downwardly at least partially through a circular gap defined between the rotor and the stator.

According to an embodiment of the disclosure, the scroll compressor further includes a flow passage defined by an inner surface of the hermetic casing and an outer circumferential surface of the oil sump fairing. In others words, the circumferential wall portion is located at a radial distance from an inner surface of the hermetic casing, and particularly from an inner surface of a midshell of the hermetic casing, so as to define, with the inner surface of the hermetic casing, a flow passage. Such a configuration of the circumferential wall portion ensures that oil present on the inner surface of the hermetic casing can flow by gravity into the oil sump.

According to an embodiment of the disclosure, the flow passage is defined by the inner surface of the hermetic casing and an outer circumferential surface of the circumferential wall portion.

According to an embodiment of the disclosure, the flow passage is annular.

According to an embodiment of the disclosure, the scroll compressor further includes a lower bearing arrangement configured to rotatably support a lower end part of the drive shaft, the oil sump fairing being axially arranged between the lower end of the electric motor and the lower bearing arrangement.

According to an embodiment of the disclosure, the inner circumferential edge of the bottom portion is located above the lower bearing arrangement.

According to an embodiment of the disclosure, the lower bearing arrangement comprises a radial bearing sleeve configured to rotatably support the lower end part of the drive shaft. Advantageously, the radial bearing sleeve surrounds the lower end part of the drive shaft and is arranged coaxially with the drive shaft.

According to an embodiment of the disclosure, the lower bearing arrangement comprises an upper axial thrust bearing and a lower axial thrust bearing configured to limit an axial movement of the drive shaft during operation.

According to an embodiment of the disclosure, the inner circumferential edge of the bottom portion is located above the radial bearing sleeve and the lower axial thrust bearing.

According to an embodiment of the disclosure, the scroll compressor further includes a support secured to the hermetic casing and configured to support the lower bearing arrangement, the oil sump fairing being secured to the support.

According to an embodiment of the disclosure, the orbiting scroll is supported by and in slidable contact with a support arrangement arranged within the hermetic casing.

According to an embodiment of the disclosure, the scroll compressor includes an oil return conduit including an oil inlet port emerging in an oil reservoir defined by the support arrangement and an oil outlet port fluidly connected to the oil sump, the oil return conduit being configured to return a part of the oil contained in the oil reservoir towards the oil sump.

According to an embodiment of the disclosure, the oil return conduit extends through a passage opening provided on the bottom portion.

According to an embodiment of the disclosure, the oil return conduit is secured to the support arrangement.

BRIEF DESCRIPTION OF THE DRAWINGS

The following detailed description of one embodiment of the disclosure is better understood when read in conjunction with the appended drawings being understood, however, that the disclosure is not limited to the specific embodiment disclosed.

DETAILED DESCRIPTION

Figure 1:
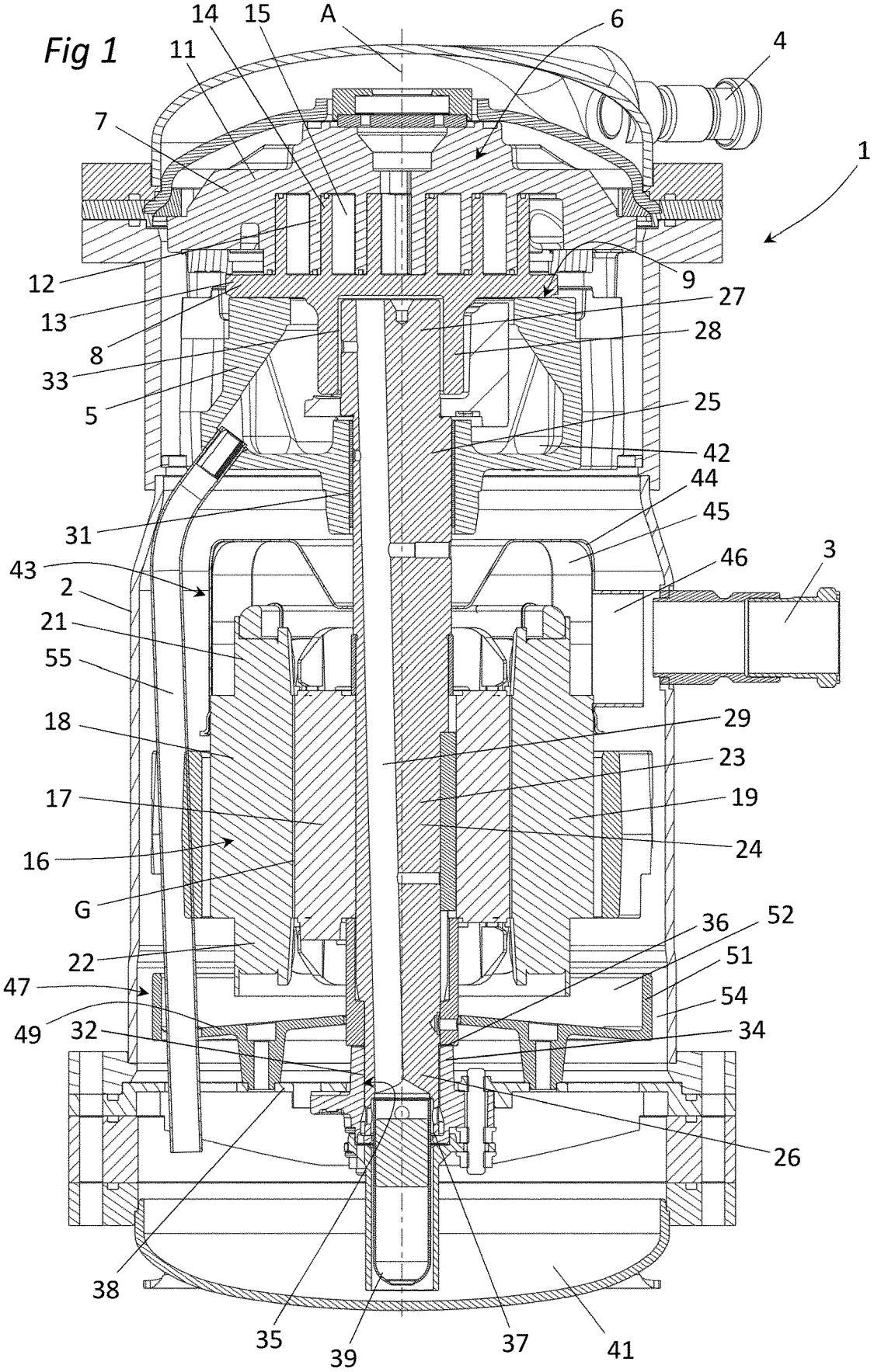
FIG. 1 is a longitudinal cross-section view of a scroll compressor according to the present disclosure.

FIG. 1 describes a scroll compressor 1 according to an embodiment of the disclosure occupying a vertical position.

The scroll compressor 1 includes a hermetic casing 2 provided with a suction inlet 3 configured to supply the scroll compressor 1 with refrigerant to be compressed, and with a discharge outlet 4 configured to discharge compressed refrigerant.

The scroll compressor 1 further includes a support arrangement 5 fixed to the hermetic casing 2, and a compression unit 6 arranged within the hermetic casing 2 and supported by the support arrangement 5. The compression unit 6 is configured to compress the refrigerant supplied by the suction inlet 3. The compression unit 6 includes a fixed scroll 7, which is fixed in relation to the hermetic casing 2, and an orbiting scroll 8 supported by and in slidable contact with a thrust bearing surface 9 provided on the support arrangement 5.

The fixed scroll 7 includes a fixed base plate 11 having a lower face oriented towards the orbiting scroll 8, and an upper face opposite to the lower face of the fixed base plate 11. The fixed scroll 7 also includes a fixed spiral wrap 12 projecting from the lower face of the fixed base plate 11 towards the orbiting scroll 8.

The orbiting scroll 8 includes an orbiting base plate 13 having an upper face oriented towards the fixed scroll 7, and a lower face opposite to the upper face of the orbiting base plate 13 and slidably mounted on the thrust bearing surface 9. The orbiting scroll 8 also includes an orbiting spiral wrap 14 projecting from the upper face of the orbiting base plate 13 towards the fixed scroll 7. The orbiting spiral wrap 14 of the orbiting scroll 8 meshes with the fixed spiral wrap 12 of the fixed scroll 7 to form a plurality of compression chambers 15 between them. Each of the compression chambers 15 has a variable volume which decreases from the outside towards the inside, when the orbiting scroll 8 is driven to orbit relative to the fixed scroll 7.

The scroll compressor 1 further includes an electric motor 16, which may be a variable-speed electric motor, disposed below the support arrangement 5. The electric motor 16 has a rotor 17, and a stator 18 disposed around the rotor 17. Advantageously, a circular gap G is defined between the rotor 17 and the stator 18.

The stator 18 includes a stator core 19 and a stator windings wound on the stator core 19. The stator windings define an upper stator end winding 21 which is formed by the portions of the stator windings extending upwardly from an upper axial end face of the stator core 19, and a lower stator end winding 22 which is formed by the portions of the stator windings extending downwardly from a lower axial end face of the stator core 19.

Furthermore, the scroll compressor 1 includes a drive shaft 23 which is vertical and rotatable around a rotational axis A. The drive shaft 23 is secured to the rotor 17 of the electric motor 16 such that the electric motor 16 is configured to drive in rotation the drive shaft 23 about the rotational axis A. The drive shaft 23 is particularly configured to drive the orbiting scroll 8 in an orbital movement when the electric motor 16 is operated.

The drive shaft 23 includes a longitudinal main part 24 including an upper end part 25 and a lower end part 26. The drive shaft 23 further includes a driving portion 27 which is provided at an upper end of the longitudinal main part 24 and which is offset from the longitudinal axis of the drive shaft 23. The driving portion 27 is partially mounted in a hub portion 28 provided on the orbiting scroll 8, and is configured to cooperate with the hub portion 28 so as to drive the orbiting scroll 8 in orbital movements relative to the fixed scroll 7 when the electric motor 16 is operated.

The drive shaft 23 also includes an oil supplying channel 29 formed within the drive shaft 23 and extending over at least a part of the length of the drive shaft 23. According to the embodiment shown on the figures, the oil supplying channel 29 extends along the entire length of the drive shaft 23 and emerge in an upper axial end surface of the drive shaft 23.

The scroll compressor 1 further includes an upper bearing arrangement 31 provided on the support arrangement 5 and configured to rotatably support the upper end part 25 of the longitudinal main part 24, and a lower bearing arrangement 32 configured to rotatably support the lower end part 26 of the longitudinal main part 24. The scroll compressor 1 also includes an orbiting scroll hub bearing 33 provided on the orbiting scroll 8 and arranged for cooperating with the driving portion 27 of the drive shaft 23.

As shown on FIG. 1, the lower bearing arrangement 32 comprises a radial bearing sleeve 34 configured to rotatably support the lower end part 26 of the drive shaft 23. The radial bearing sleeve 34 is arranged coaxially with the drive shaft 23, and includes an inner radial bearing surface 35 which is cylindrical and which surrounds the lower end part 26 of the drive shaft 23.

Furthermore, the lower bearing arrangement 32 comprises upper and lower axial thrust bearings 36, 37 configured to limit an axial movement of the drive shaft 23 during operation. Advantageously, the upper axial thrust bearing 36 is located above the inner radial bearing surface 35, and the lower axial thrust bearing 37 is located below the inner radial bearing surface 35.

The scroll compressor 1 further includes a support 38 secured to the hermetic casing 2 and configured to support the lower bearing arrangement 32. The lower bearing arrangement 32 is secured to the support 38 for example by use of screws or bolts.

The scroll compressor 1 also includes an oil pump 39 arranged at a lower end of the drive shaft 23 and immersed in an oil sump 41 arranged in a lower part of the hermetic casing 2. The oil pump 39 is configured to deliver, during operation of the scroll compressor 1, oil, from the oil sump 41, to the compression unit 6 and to the upper and lower bearing arrangements 31, 32 through the oil supplying channel 29 formed within the drive shaft 23.

According to an embodiment of the disclosure, the support arrangement 5 defines an inner volume in which the driving portion 27 of the drive shaft 23 and the hub portion 28 provided on the orbiting scroll 8 are received, and an oil reservoir 42 is formed at a bottom of the inner volume. Advantageously, the oil reservoir 42 is annular and extends around the drive shaft 23.

The scroll compressor 1 further includes a refrigerant guiding device 43 configured to force a main part, and advantageously substantially the entire, of the refrigerant, entering the scroll compressor 1 through the suction inlet 3, to flow through the electric motor 16 from the upper stator end winding 21 to the lower stator end winding 22, before reaching the compression unit 6.

The refrigerant guiding device 43 includes a motor cover 44 arranged at and covering the upper stator end winding 21 of the electric motor 16. According to the embodiment shown on the figures, the motor cover 44 is attached to the stator core 19, and surrounds the drive shaft 23. The motor cover 44 and the electric motor 16 at least partially define an inner chamber 45 which is advantageously annular and which contains the upper stator end winding 21.

As shown on FIG. 1, the motor cover 44 includes a refrigerant inlet opening 46 emerging in the inner chamber 45 and at least partially facing the suction inlet 3. Advantageously, the refrigerant inlet opening 46 has a cross-section which is higher than a cross-section of the suction inlet 3.

The refrigerant guiding device 43 is particularly configured to force a main part, advantageously substantially the entire, of the refrigerant, entering the scroll compressor 1 through the suction inlet 3, to flow through the refrigerant inlet opening 46 before flowing through the electric motor 16 from the upper stator end winding 21 to the lower stator end winding 22. Advantageously, the refrigerant guiding device 43 is configured to force the refrigerant entering the inner chamber 45 to flow downwardly at least partially through the circular gap G defined between the rotor 17 and the stator 18.

The scroll compressor 1 further includes an oil sump fairing 47 arranged between a lower end of the electric motor 16 and a free surface of oil stored in the oil sump 41, and being axially offset from the electric motor 16. The oil sump fairing 47 may for example be secured to the support 38.

The oil sump fairing 47 is configured to prevent a refrigerant flow, flowing downwardly through the electric motor 16 and coming out of, i.e. emerging from, the electric motor 16, to directly impact the free surface of the oil stored in the oil sump 41. Particularly, the oil sump fairing 47 is configured to deflect the refrigerant flow, flowing downwardly through the electric motor 16 and coming out of the electric motor 16, away from the oil sump 41, and advantageously towards the compression unit 6. Therefore, the oil sump fairing 47 forms an oil sump protective shield.

According to the embodiment shown on the figures, the oil sump fairing 47 has a central opening 48 for accommodating the drive shaft 23, and surrounds the lower end part 26 of the drive shaft 23. Advantageously, the oil sump fairing 47 is arranged coaxially with the electric motor 16.

Figure 2:
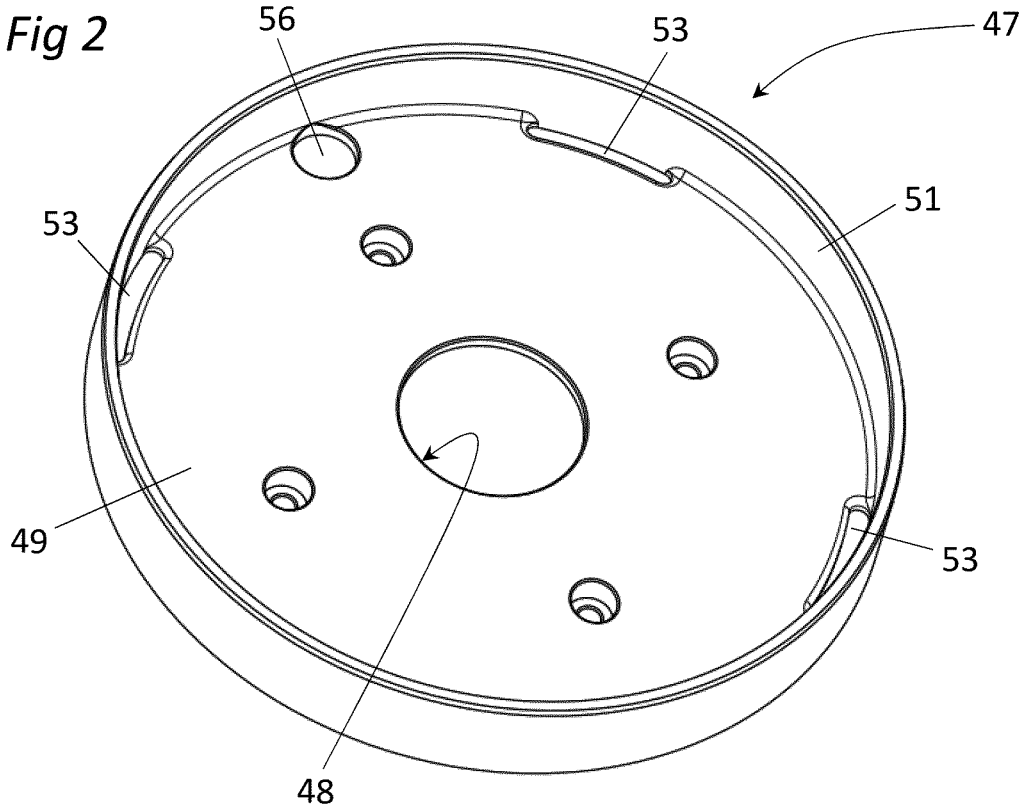
FIG. 2 is a perspective view from above of an oil sump fairing of the scroll compressor of FIG. 1.

As shown on the FIGS. 1 and 2, the oil sump fairing 47 is cup-shaped and includes: a bottom portion 49 which is facing a lower axial end of the electric motor 16 and which at least partially covers the oil sump 41, the bottom portion 49 having globally a disc-shape and having an inner circumferential edge and an outer circumferential edge, and a circumferential wall portion 51 having advantageously a cylindrical shape, the circumferential wall portion 51 extending along the outer circumferential edge of the bottom portion 49 and upwardly from said outer circumferential edge.

Particularly, the bottom portion 49 includes a first annular part facing a lower axial end of the rotor 17 and delimiting the central opening 48, and a second annular part being formed radially outward of the first annular part and facing a lower axial end of the stator 18.

Advantageously, the circumferential wall portion 51 and the electric motor 16 extend coaxially, and the circumferential wall portion 51 has an inner diameter which is higher than an outer diameter of the stator core 19.

According to the embodiment shown on the figures, the circumferential wall portion 51 surrounds a lower end portion of the lower stator end winding 22 with a predetermined distance, such that a refrigerant flow path 52, advantageously having a ring-shaped cross section, is formed between an inner surface of the circumferential wall portion 51 and the lower end portion of the lower stator end winding 22. Such a configuration of the circumferential wall portion 51 ensures that the refrigerant, emerging from the lower end of the electric motor 16, may flow through the refrigerant flow path 52 and close to the lower stator end winding 22, which ensures an optimal cooling of the latter.

Figure 3:
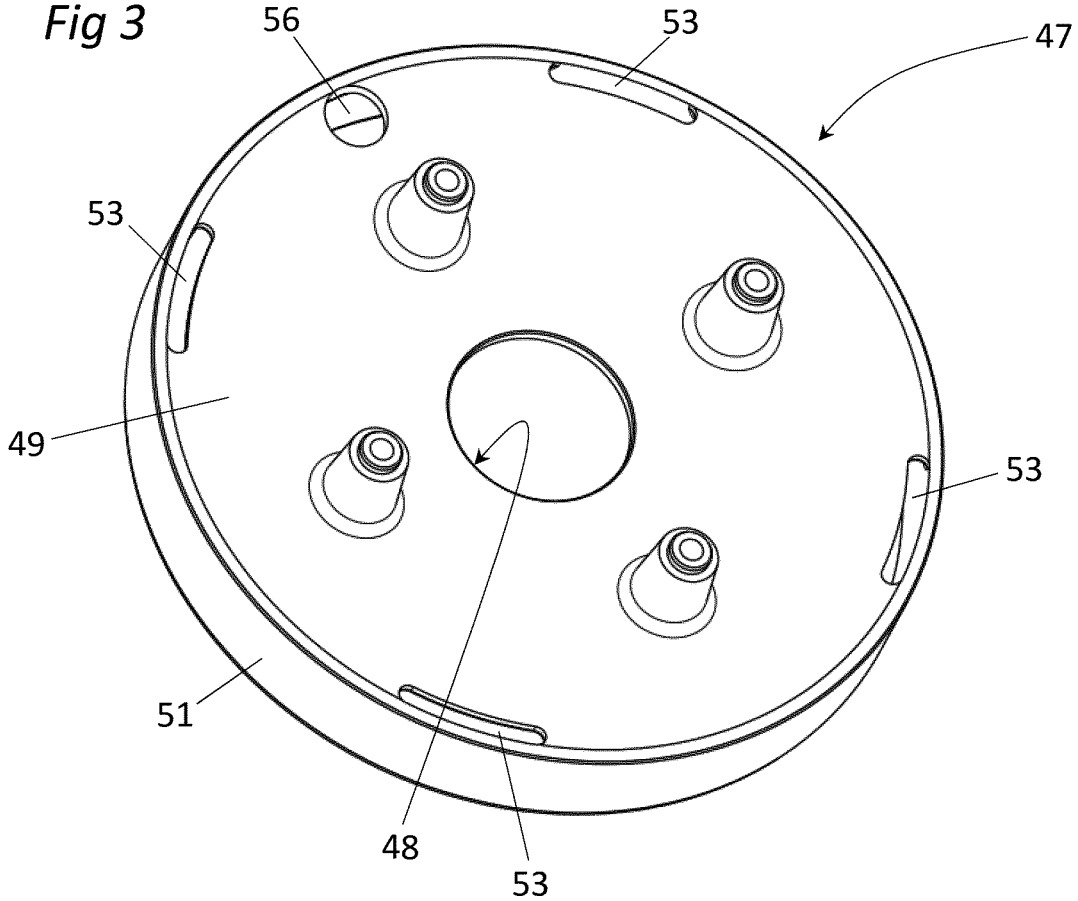
FIG. 3 is a perspective view from below of the oil sump fairing of FIG. 2.

As better shown on FIGS. 2 and 3, the bottom portion 49 comprises at least one oil drain opening 53 configured to drain oil collected by the oil sump fairing 47 towards the oil sump 41. According to the embodiment shown on the figures, the bottom portion 49 comprises several oil drain openings distributed, and for example evenly distributed, around the drive shaft 23. Advantageously, the or each oil drain opening 53 is formed at or close to the outer circumferential edge of the bottom portion 49. The or each oil drain opening 53 may be elongated and extend along a part of the outer circumferential edge of the bottom portion 49.

According to the embodiment shown on the figures, the bottom portion 49 is conically shaped, and the outer circumferential edge of the bottom portion 49 is closer to the oil sump than the inner circumferential edge of the bottom portion 49. Due to such a configuration, the bottom portion 49 is configured to orient oil collected by the oil sump fairing 47 towards the outer circumferential edge of the bottom portion 49, and thus towards the oil drain opening(s) 53.

According to the embodiment shown on the figures, the oil sump fairing 47 is axially arranged between the lower end of the electric motor 16 and the lower bearing arrangement 32. Advantageously, the inner circumferential edge of the bottom portion 49 is located above the lower bearing arrangement 32, and particularly above the radial bearing sleeve 34 and the lower axial thrust bearing 37. Due to such a configuration, the oil flowing from the lower bearing arrangement 32 is prevented to be carried over by the refrigerant emerging from the lower end of the electric motor 16, which limit the OCR within the refrigeration system.

The scroll compressor 1 further includes a flow passage 54 defined by an inner surface of the hermetic casing 2 and an outer circumferential surface of the oil sump fairing 47. In others words, the circumferential wall portion 51 is located at a radial distance from an inner surface of the hermetic casing 2, and particularly from an inner surface of a midshell of the hermetic casing 2, so as to define, with the inner surface of the hermetic casing 2, the flow passage 54. Advantageously, the flow passage 54 is annular, and is defined by the inner surface of the hermetic casing 2 and an outer circumferential surface of the circumferential wall portion 51. The flow passage 54 ensures that oil present on the inner surface of the hermetic casing can flow by gravity into the oil sump 41.

The scroll compressor 1 may further include an oil return conduit 55 secured to the support arrangement 5 and configured to return a part of the oil contained in the oil reservoir 42 towards the oil sump 41. The oil return conduit 55 may include an oil inlet port emerging in the oil reservoir 42 defined by the support arrangement 5, and an oil outlet port fluidly connected to the oil sump 41. Advantageously, the oil return conduit 55 may extend through a passage opening 56 provided on the bottom portion 49.

The operation of the scroll compressor 1 will now be described.

When the scroll compressor 1 according to the disclosure is turned on, the orbiting scroll 8 is driven by the drive shaft 23 following an orbital movement, this movement of the orbiting scroll 8 causing an intake of refrigerant in the hermetic casing 2 through the suction inlet 3. Due to the fact that the refrigerant inlet opening 46 is facing the suction inlet 3, a main part of the refrigerant, entering the scroll compressor 1 through the suction inlet 3, is forced to flow through the refrigerant inlet opening 46 and into the inner chamber 45. Then, the refrigerant entering the inner chamber 45 is forced to flow downwardly through the electric motor 16, and at least partially through the circular gap G, from the upper stator end winding 21 to the lower stator end winding 22. Such a refrigerant flow, which includes oil droplets, ensures an optimal cooling of the electric motor 16, and particularly of the lower stator end winding 22.

Due to the presence of the oil sump fairing 47, the refrigerant emerging from the electric motor 16 impacts the oil sump fairing 47 and is deviated upwardly, i.e. away from the oil sump 41 and towards the compression unit 6. Finally, the refrigerant flow is compressed by the compression unit 6 and exits the scroll compressor 1 through the discharge outlet 4.

By avoiding a direct impact of the refrigerant emerging from the electric motor 16 on the oil contained in the oil sump 41, the creation of oil droplets at the free surface of the oil stored in the sump 41 is avoided, which limits the quantity of oil carried by the refrigerant flowing in the hermetic casing 2 and thus reduces the oil circulation rate within the refrigeration system.

In addition, such a U-turn of the refrigerant strongly reduces the speed of the latter at the lower stator end winding 22, which further improves the motor cooling, and also at the free surface of the oil stored in the oil sump 41, which further limit the oil circulation rate within the refrigeration system. Furthermore, such a U-turn of the refrigerant favours a gravity fall of the oil droplets carried by the refrigerant, which also limit the oil circulation rate within the refrigeration system, particularly for variable speed compressor.

Consequently, the oil sump fairing 47 acts notably as a motor cooling baffle, an oil sump protective shield and an oil separator.

Moreover, the oil sump fairing 47 acts as an oil level limitation. Indeed, in case of the oil level in the oil sump 41 increases and reaches the oil sump fairing 47, the over quantity of oil will pass through the oil drain opening(s) 53, and the oil above the oil sump fairing 47 will be dragged by the refrigerant flow coming out of the electric motor 16, which will prevent a too high level of the oil within the oil sump 41. This principle can be very useful for manifolding configuration (when several compressors are connected to one same frigorific system), since it prevents the emptying of the oil sump of the other compressor(s).

Of course, the disclosure is not restricted to the embodiments described above by way of non-limiting examples, but on the contrary it encompasses all embodiments thereof.

One of ordinary skill in the art would understand that the above-described embodiments are exemplary and non-limiting. That is, modifications of this disclosure would come within the scope of the claims. Accordingly, the following claims should be studied to determine their true scope and content.

The invention claimed is:

1. A scroll compressor including:

a hermetic casing provided with a suction inlet configured to supply the scroll compressor with refrigerant to be compressed;

a compression unit arranged within the hermetic casing and configured to compress the refrigerant supplied by the suction inlet;

a drive shaft configured to drive an orbiting scroll of the compression unit in an orbital movement, the drive shaft being rotatable around a rotation axis;

an electric motor coupled to the drive shaft and configured to drive in rotation the drive shaft about the rotational axis (A), the electric motor including a rotor which is secured to the drive shaft and a stator which is disposed around the rotor, the stator including a stator core and stator windings wound on the stator core, the stator windings defining an upper stator end winding and a lower stator end winding;

an oil sump located at a lower part of the hermetic casing;

a refrigerant guiding device configured to force a main part of the refrigerant, entering the scroll compressor through the suction inlet, to flow through the electric motor from the upper stator end winding to the lower stator end winding, before reaching the compression unit; and an oil sump fairing arranged between a lower axial end of the electric motor and a free surface of oil stored in the oil sump, the oil sump fairing being configured to prevent a refrigerant flow, flowing downwardly through the electric motor and coming out of the electric motor, from directly impacting the free surface of the oil stored in the oil sump;

wherein the oil sump fairing is cup-shaped with an outer circumferential edge extending in a direction toward the compression unit; and further including a flow passage defined by an inner surface of the hermetic casing and an outer circumferential surface of the oil sump fairing.

2. The scroll compressor according to claim 1, wherein the oil sump fairing is configured to deflect, and particularly to orient, the refrigerant flow, flowing downwardly through the electric motor and coming out of the electric motor, away from the oil sump.

3. The scroll compressor according to claim 1, wherein the oil sump fairing surrounds the drive shaft.

4. The scroll compressor according to claim 1, wherein the oil sump fairing is arranged substantially coaxially with the electric motor.

5. The scroll compressor according to claim 1, wherein the oil sump fairing includes:

a bottom portion which is facing the lower axial end of the electric motor, the bottom portion having an inner circumferential edge and an outer circumferential edge; and a circumferential wall portion extending along the outer circumferential edge of the bottom portion and upwardly from said outer circumferential edge.

6. The scroll compressor according to claim 5, wherein the circumferential wall portion surrounds a lower end portion of the lower stator end winding with a predetermined distance, such that a refrigerant flow path is formed between an inner surface of the circumferential wall portion and the lower end portion of the lower stator end winding.

7. The scroll compressor according to claim 5, wherein the bottom portion comprises at least one oil drain opening configured to drain oil collected by the oil sump fairing towards the oil sump.

8. The scroll compressor according to claim 7, wherein the at least one oil drain opening is formed at or close to the outer circumferential edge of the bottom portion.

9. The scroll compressor according to claim 1, wherein the oil sump fairing has a central opening for accommodating the drive shaft.

10. The scroll compressor according to claim 1, wherein the refrigerant guiding device includes a motor cover arranged at and covering the upper stator end winding of the electric motor, the motor cover and the electric motor at least partially defining an inner chamber containing the upper stator end winding, the motor cover including a refrigerant inlet opening emerging in the inner chamber and at least partially facing the suction inlet.

11. The scroll compressor according to claim 1, further including a lower bearing arrangement configured to rotatably support a lower end part of the drive shaft, the oil sump fairing being axially arranged between the lower end of the electric motor and the lower bearing arrangement.

12. The scroll compressor according to claim 11, further including a support secured to the hermetic casing and configured to support the lower bearing arrangement, the oil sump fairing being secured to the support.

13. A scroll compressor including:

a hermetic casing provided with a suction inlet configured to supply the scroll compressor with refrigerant to be compressed;

a compression unit arranged within the hermetic casing and configured to compress the refrigerant supplied by the suction inlet;

a drive shaft configured to drive an orbiting scroll of the compression unit in an orbital movement, the drive shaft being rotatable around a rotation axis;

an electric motor coupled to the drive shaft and configured to drive in rotation the drive shaft about the rotational axis (A), the electric motor including a rotor which is secured to the drive shaft and a stator which is disposed around the rotor, the stator including a stator core and stator windings wound on the stator core, the stator windings defining an upper stator end winding and a lower stator end winding;

an oil sump located at a lower part of the hermetic casing;

a refrigerant guiding device configured to force a main part of the refrigerant, entering the scroll compressor through the suction inlet, to flow through the electric motor from the upper stator end winding to the lower stator end winding, before reaching the compression unit;

an oil sump fairing arranged between a lower axial end of the electric motor and a free surface of oil stored in the oil sump, the oil sump fairing being configured to prevent a refrigerant flow, flowing downwardly through the electric motor and coming out of the electric motor, from directly impacting the free surface of the oil stored in the oil sump;

wherein the oil sump fairing includes:

a bottom portion which is facing the lower axial end of the electric motor, the bottom portion having an inner circumferential edge and an outer circumferential edge; and a circumferential wall portion extending along the outer circumferential edge of the bottom portion and upwardly from said outer circumferential edge;

further including a flow passage defined by an inner surface of the hermetic casing and an outer circumferential surface of the oil sump fairing; and wherein the bottom portion is conically shaped, the outer circumferential edge of the bottom portion being closer to the oil sump than the inner circumferential edge of the bottom portion.

14. The scroll compressor according to claim 13, wherein the oil sump fairing is cup-shaped with an outer circumferential edge extending in a direction toward the compression unit.

15. The scroll compressor according to claim 13, further including a lower bearing arrangement configured to rotatably support a lower end part of the drive shaft, the oil sump fairing being axially arranged between the lower end of the electric motor and the lower bearing arrangement.

16. The scroll compressor according to claim 15, further including a support secured to the hermetic casing and configured to support the lower bearing arrangement, the oil sump fairing being secured to the support.

17. A scroll compressor including:

a hermetic casing provided with a suction inlet configured to supply the scroll compressor with refrigerant to be compressed;

a compression unit arranged within the hermetic casing and configured to compress the refrigerant supplied by the suction inlet;

a drive shaft configured to drive an orbiting scroll of the compression unit in an orbital movement, the drive shaft being rotatable around a rotation axis;

an electric motor coupled to the drive shaft and configured to drive in rotation the drive shaft about the rotational axis (A), the electric motor including a rotor which is secured to the drive shaft and a stator which is disposed around the rotor, the stator including a stator core and stator windings wound on the stator core, the stator windings defining an upper stator end winding and a lower stator end winding;

an oil sump located at a lower part of the hermetic casing;

a refrigerant guiding device configured to force a main part of the refrigerant, entering the scroll compressor through the suction inlet, to flow through the electric motor from the upper stator end winding to the lower stator end winding, before reaching the compression unit; and an oil sump fairing arranged between a lower axial end of the electric motor and a free surface of oil stored in the oil sump, the oil sump fairing being configured to prevent a refrigerant flow, flowing downwardly through the electric motor and coming out of the electric motor, from directly impacting the free surface of the oil stored in the oil sump; and further including a flow passage defined by an inner surface of the hermetic casing and an outer circumferential surface of the oil sump fairing, said flow passage extending around an entire outer circumference of the oil sump fairing.

18. The scroll compressor according to claim 17, wherein the oil sump fairing is cup-shaped with an outer circumferential edge extending in a direction toward the compression unit.

19. The scroll compressor according to claim 17, wherein a bottom portion is conically shaped, and an outer circumferential edge of the bottom portion is closer to the oil sump than an inner circumferential edge of the bottom portion.

20. The scroll compressor according to claim 17, further including a lower bearing arrangement configured to rotatably support a lower end part of the drive shaft, the oil sump fairing being axially arranged between the lower end of the electric motor and the lower bearing arrangement, further including a support secured to the hermetic casing and configured to support the lower bearing arrangement, the oil sump fairing being secured to the support.

* * * * *